US005133496A

United States Patent [19]

Davidson et al.

[11] Patent Number: 5,133,496

[45] Date of Patent: Jul. 28, 1992

[54] COMBINATION GREETING CARD AND GIFT POUCH

[75] Inventors: Leon N. Davidson, Reseda; Ray L. Solari, Beverly Hills, both of Calif.

[73] Assignee: Cards and Pouches, Inc., Beverly Hills, Calif.

[21] Appl. No.: 753,641

[22] Filed: Aug. 30, 1991

[51] Int. Cl.[5] ..... B65D 27/34

[52] U.S. Cl. ..... 229/92.8; 229/313; 229/71; 40/158.1

[58] Field of Search ..... 229/1.5 R, 92.8, 305, 229/313, 71; 40/158.1, 159.1, 159.2

[56] References Cited

U.S. PATENT DOCUMENTS 4,167,241 9/1979 Zumbrunn ..... 229/92.8
4,640,030 2/1987 Wood et al. ..... 229/928 X

FOREIGN PATENT DOCUMENTS 10006 4/1909 France ..... 229/71
284923 4/1931 Italy ..... 229/71
102650 12/1916 United Kingdom ..... 229/92.8

*Primary Examiner*—Stephen P. Garbe
*Assistant Examiner*—Jes F. Pascua
*Attorney, Agent, or Firm*—George J. Netter

[57] ABSTRACT

A combination greeting card and gift pouch is constructed from a single rectangular blank (10) having three panel zones (12, 14, 16) arranged side-by-side and separated by fold lines (18, 20). The first panel zone (12) at one end of blank (10) has a central portion partially enclosed by a set of perforations (22) which on separation enables folding out of the central portion. Third, panel zone (16) at the opposite end of the blank folds onto panel zone (14) and has side flaps (36, 38) that are secured to panel zone (14) forming a gift pouch (40) with access along fold line (18). The first panel zone (12) is folded about fold line (18) onto the gift pouch and for sealing is secured thereto by adhesive on panel edge margin (34).

5 Claims, 2 Drawing Sheets

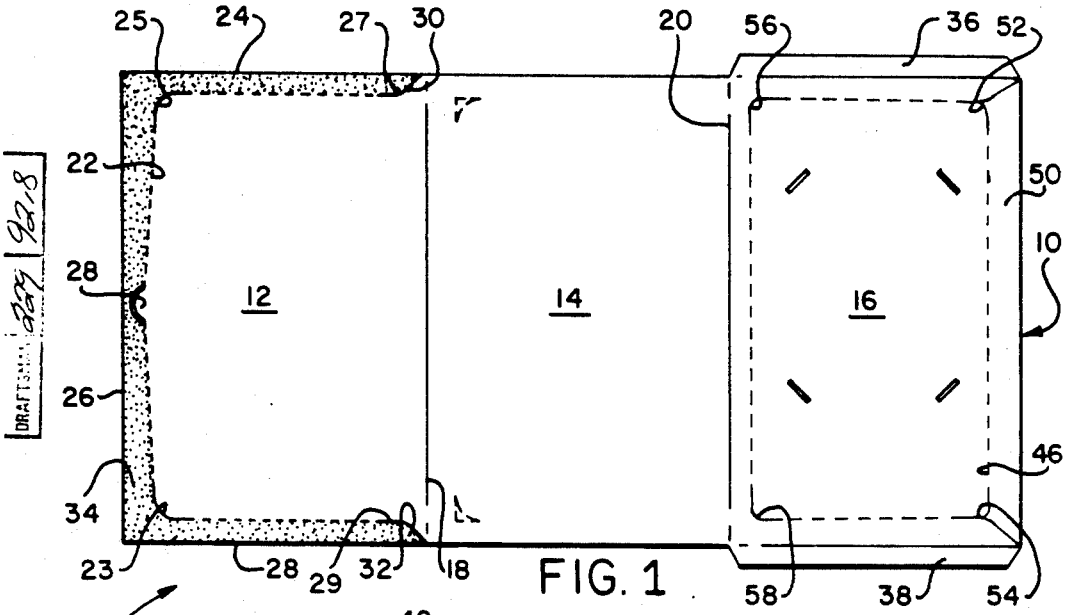
FIG. 1
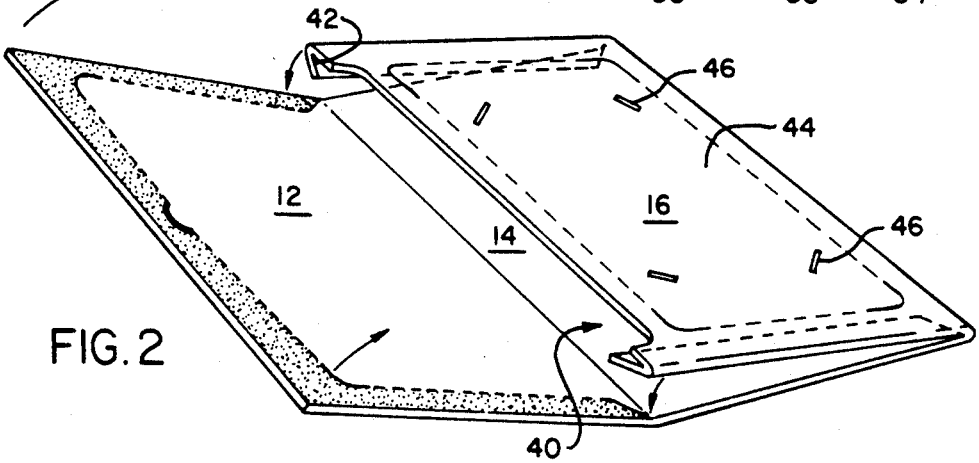
FIG. 2
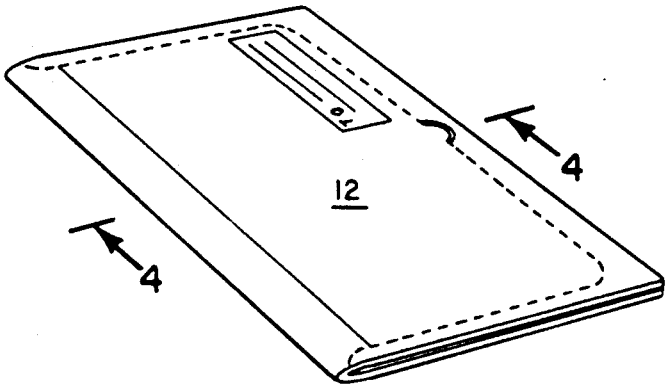
FIG. 3
FIG. 4
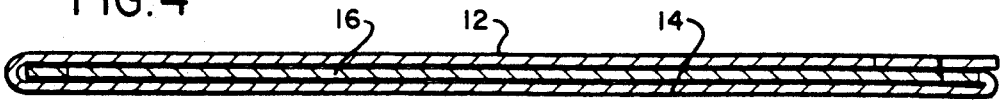

COMBINATION GREETING CARD AND GIFT POUCH

BACKGROUND

The present invention relates generally to a greeting card and, more particularly, to a greeting card including unitary gift pouch means.

SUMMARY OF THE INVENTION

In accordance with the present invention, a combination greeting card and gift pouch construction is formed from a generally rectangular sheet-like paper or cardboard base consisting of three panels. The first panel, which is adjacent one end, includes a central portion that is partially enclosed by a set of perforations which upon being separated allows the central portion to fold out and away from the remainder. The opposite end or third panel is folded onto the second or central panel with side flaps being secured about the central panel to form a large envelope or, more properly, a gift pouch having an access opening along the boundary between the first and second panels. Also, the central portion of the third panel is enclosed by perforations enabling selective removal.

The first panel is folded onto an outer surface of the pouch and when the perforated central part of the first panel is separated this exposes the outer side surface of the envelope. It is contemplated that a message, design, view or combination thereof can be provided on the outer surface of the pouch such that when the perforated central portion of the first panel is laid back it will then reveal the message, design or view. The first panel also includes a quantity of adhesive arranged in a path along three of the panel edge margins which after having a protective strip removed can be pressed against the pouch outer surface sealing the first panel to the third panel. The outer surface of the first panel is especially adapted for including name and address of sender and the one to whom the greeting card is being sent.

DESCRIPTION OF THE DRAWING

In the accompanying drawings:

FIG. 1 is a front elevational view of the greeting card and envelope of the present invention shown in its fully opened and unassembled condition;

FIG. 2 is a perspective view of the greeting card and envelope of FIG. 1 shown partially assembled;

FIG. 3 shows a fully assembled greeting card and envelope of the present invention;

FIG. 4 is a side elevational sectional view taken along the line 4—4 of FIG. 3;

DESCRIPTION OF A PREFERRED EMBODIMENT

Figure 5:
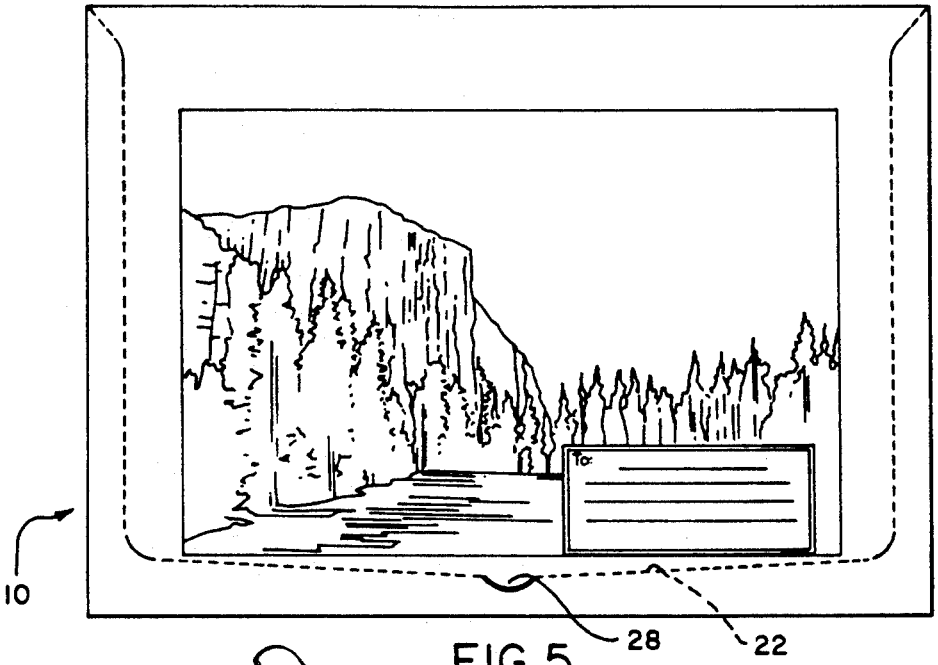
FIG. 5 shows a typical front view of the invention in its final condition.
Figure 6:
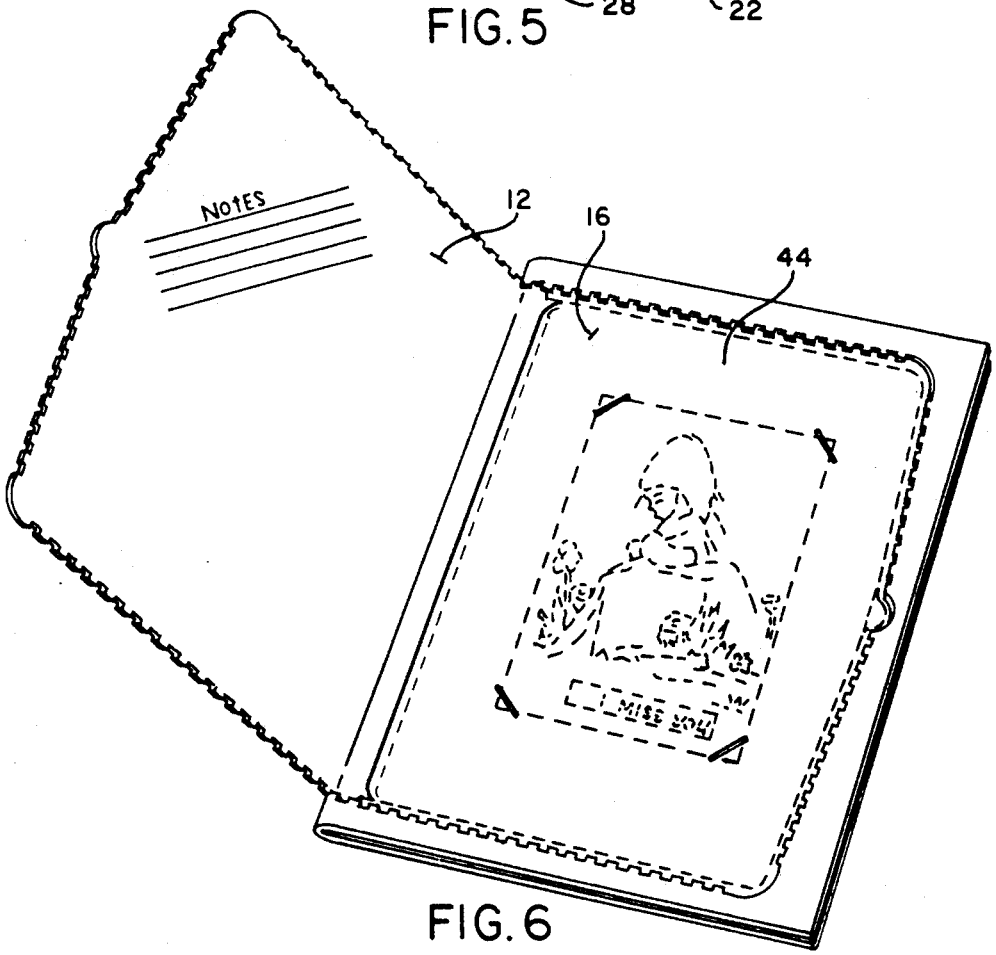
FIG. 6 shows the greeting card and envelope of FIG. 5 with a perforated front flap peeled back.

Turning now to the drawings and particularly FIG. 1 there is shown the initial cutout blank 10 which on assembly, in a manner to be described, forms the invention. More particularly, the blank is generally rectangular with three substantially equal area panel zones 12, 14 and 16 arranged adjacent each other along the blank long dimension and separated by parallel fold lines 18 and 20. As will be more particularly described, the blank 10 when fully assembled provides a combination greeting card and gift pouch with portions of the view or statement on the greeting card becoming visible when a perforated portion of a panel is folded back.

Panel 12 is at one end of the blank 10 and includes a perforated line 22 that is located just inwardly of the outer edge and extends along a first side 24, the blank end 26 and a second side 28. It is important to note that the perforated line is generally parallel to the first and second sides 24 and 28, but it tapers along end 26 from a maximum adjacent each of the two sides to a minimum at the midpoint of the end edge. The purpose of the tapering is to make breaking of the perforations easier and more positive when the pull tab 28 has pressure applied to it. That is, pulling pressure on the tab will be exerted more closely along the tapered line of perforations giving it a substantial mechanical advantage which would not be the case if the line of perforations were parallel to the outer edge. Moreover, as the perforation line 22 approaches fold line 18 at 30 and 32, the line is directed angularly outwardly so as to intersect the blank sides 24 and 28 at approximately 45 degrees. Still further, the line of perforations 22 is interrupted by curved die cut lines at pull tab 28, corner regions 23, 25 and at 27, 29 immediately adjacent angular lines 30, 32.

The panel edge margin 34 just outwardly of the perforated line is provided on one surface as shown in FIGS. 1 and 2 with a suitable adhesive material for a purpose to be described.

The panel 16 which is located adjacent the opposite edge from that of panel 12 includes first and second flaps 36 and 38 extending along its two side edges and which flaps can be folded back over the main central region of panel 16. As can be seen best in FIG. 2, the flaps are folded back across the face of panel 16 and then the entire panel with folded flaps is folded about the fold line 20 so that the flaps now contact the side edge portions of the panel 14 (FIG. 2). Preferably, the flaps are secured to the central panel 14 by a suitable adhesive material forming an envelope or pouchlike compartment identified generally as 40 with a single access opening 42 along fold line 20. It is contemplated that the panel 16 outer surface shall be provided with a design, picture, view, greeting card message or combination thereof. Accordingly, the surface 44 shall be referred to herein as the greeting card view area. More particularly, the greeting card area is enclosed by a closed path line of perforations 46 enabling easy removal of the scene, design, picture, greeting card message, or the like, for mounting or other use. Additionally, the area 44 can be provided with die cuts 48 arranged at the four corners of a rectangle of desired dimensions for mounting a photograph or other card, for example.

Still further, a detachable strip 50 is temporarily secured to panel 16 via the line of perforations 46 along the edge defining the pouch opening 40 (FIG. 2). Curved die cuts 52, 54 at the opposite ends of the strip 50 and die cuts 56, 58 at the two opposite rounded corners of the line of perforations 46 assist removal of both the strip and the area 44 from the panel. It is contemplated that the strip 50 will carry written and/or graphical instructions which after use will be pulled loose and discarded.

When used, a gift or other suitably sized object desired to be enclosed is placed in the pouch 40, the greeting card view area 44 may be signed, if desired, and the panel 12 is then folded onto the view area and secured thereto by the adhesive 34. The outer surface of panel 12 is then addressed and stamped. When the item is received pulling on the opening tab 44 separates the central part of panel 12 exposing the underlying view, design or message at 44. Further removal of panel 12 allows access to the pouch for removing the gift or other contents.

Although this invention has been described in connection with a preferred embodiment, it is to be understood that those skilled in the appertaining art may make modifications that come within the spirit of the invention and the ambit of the appended claims.

What is claimed is:

1. A combination greeting card and gift pouch, comprising:

a foldable member including first panel, a second panel separated from the first panel by a first fold line, and a third panel separated from the second panel by a second fold line;

said first panel having two opposite side edges, an end edge opposite the first fold line, and a line of perforations located generally inwardly of the side and end edges;

a quantity of adhesive located on the first panel between the line of perforations and the panel peripheral edges;

said third panel having two opposite side edges, an end edge, a closed path line of perforations defining a greeting card view, and a pair of flaps extending along the respective third panel side edges;

said greeting card and gift pouch being assembled by folding both flaps onto the same side of the third panel, folding the third panel along the second fold line with the greeting card view area facing away from the second panel, securing the flaps to the second panel, and folding the first panel about the first fold line onto the third panel and adhering them together by the quantity of adhesive.

2. A combination greeting card and gift pouch as in claim 1, in which the first panel line of perforations extends substantially parallel to the two side edges except adjacent the first fold where the line intersects the outer end of the first fold line at an angle of approximately 45 degrees, and along the first panel end edge tapers from maximum inwardly spaced points to a centrally located minimum inwardly spaced point, said minimum inwardly spaced point including a pull tab.

3. A greeting card and gift pouch as in claim 2, in which the line of perforations at the pull tab, at the two regions of juncture between those portions extending parallel to the side edges and the end edges, and immediately adjacent the intersection with the fold line are curved and die cut.

4. A greeting card and gift pouch as in claim 1, in which four die marks are angularly located within the line of perforations of the third panel at four corners of a rectangle for releasably mounting a cardlike item.

5. A greeting card and gift pouch as in claim 1, in which the third panel edge opposite the second fold line includes an edge portion strip detachable from the third panel along the third panel line of perforations.

* * * * *